US005129590A

United States Patent [19]

Shinya

[11] Patent Number: 5,129,590

[45] Date of Patent: Jul. 14, 1992

[54] GARBAGE DISPOSER

[75] Inventor: Narao Shinya, Tottori, Japan

[73] Assignee: Kabushiki Kaisha Nisseigiken, Tottori, Japan

[21] Appl. No.: 637,573

[22] Filed: Jan. 4, 1991

[30] Foreign Application Priority Data

Feb. 22, 1990 [JP] Japan ..... 2-42038

[51] Int. Cl.[5] ..... B02C 23/36

[52] U.S. Cl. ..... 241/46.013; 100/117; 210/174; 210/415; 241/46.017; 241/100; 241/101.2

[58] Field of Search ..... 210/173, 174, 415; 100/935, 94, 117; 241/100, 100.5, 46.02–46.17, 46 R, 46 A, 46 B, 101.2, 257 G

[56] References Cited

U.S. PATENT DOCUMENTS 3,188,942 6/1965 Wandel ..... 100/117 X
3,527,158 9/1970 Young ..... 100/117
4,337,901 7/1982 Ogura .

FOREIGN PATENT DOCUMENTS 793823 9/1968 Canada ..... 210/174
258656 10/1988 Japan ..... 210/173

*Primary Examiner*—P. W. Echols
*Attorney, Agent, or Firm*—Armstrong, Nikaido, Marmelstein, Kubovcik & Murray

[57] ABSTRACT

There is disclosed a garbage disposer which pulverizes kitchen garbage, drys it and discharges only the yield water into a sewage system. This apparatus includes a garbage pulverizing segment and a garbage drying segment, both of which are driven by a common motor. The garbage drying segment includes a screw with a helical blade and a cylindrical screen disposed around the screw. In this garbage drying segment the garbage is compressed and dried as it is pressure-fed by the screw within the screen. The water thus produced flows past the screen and is discharged from the garbage drying segment into the sewage system, while the dried garbage is collected in a bag.

17 Claims, 2 Drawing Sheets

GARBAGE DISPOSER

BACKGROUND OF THE INVENTION

1. Field of the Invention

The present invention relates to an apparatus for disposal of wet garbage from a kitchen. More particularly, the invention relates to a garbage disposer which pulverizes garbage, drys it and discharges only the resulting water into a sewage system.

2. Description of the Prior Art

The garbage disposer is a well-known device for disposal of kitchen garbage. The disposer is generally attached to the drain line of a kitchen sink and adapted to comminute the garbage so that it can be discharged into a sewage system.

However, when the garbage is thus finely-divided and discharged directly into a sewage system, the contamination of sewage water is so serious that a great processing burden is imposed on the downstream disposal plant. Furthermore, if such a device is used in an area where the sewage water is not further processed but discharged directly into a river or the sea, it presents a serious environmental problem.

SUMMARY OF THE INVENTION

The present invention has been conceived and accomplished to overcome the drawbacks of the prior art garbage disposer.

It is, therefore, a primary object of the present invention to provide a garbage disposer which comminutes garbage with high efficiency, drys the comminuted garbage and discharges only the component water into a sewage system with the component solid matter being retained to thereby minimize the pollution of sewage water, thus contributing to alleviation of burdens on the downstream sewage disposal plant and prevention of pollutions.

It is another oject of the present invention to provide a garbage disposer which comprises a pulverizing segment for comminuting he garbage and a dry segment for withdrawing water from the pulverized garbage in an integral combination which is compact and, therefore, space-saving and can be installed at the sink just as the prior art disposer.

The above and further objects, features and advantages of the invention will more fully appear from the following description with reference to the accompanying drawins. It is to be expressly understood, however, that the drawings are for purpose of illustration only and are not intended as a definition of the limits of the invention.

DETAILED DESCRIPTION OF THE PREFERRED EMBODIMENTS

Figure 1:
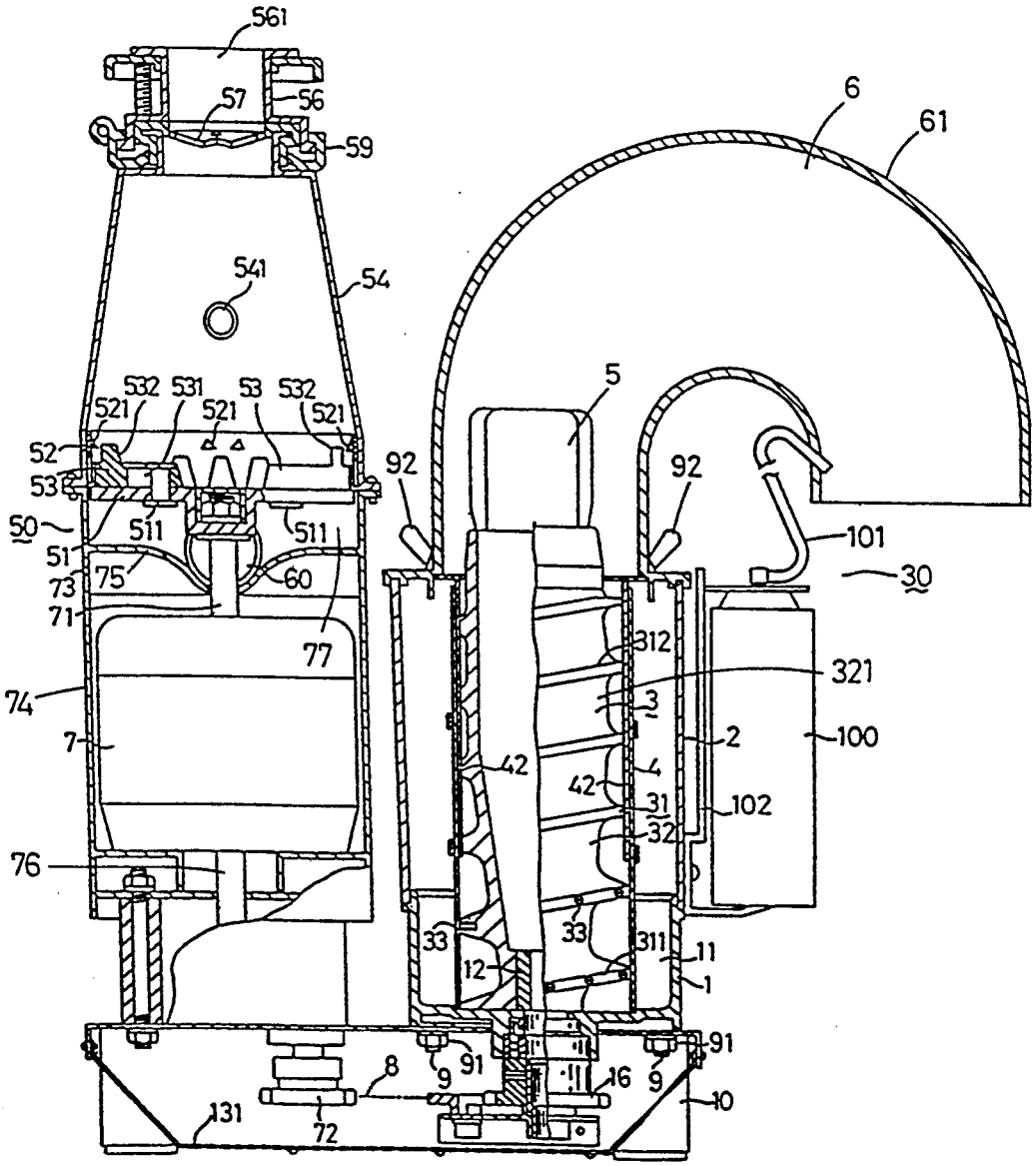
FIG. 1 is a longitudinal section view showing a garbage disposer embodying the principles of the present invention.
Figure 2:
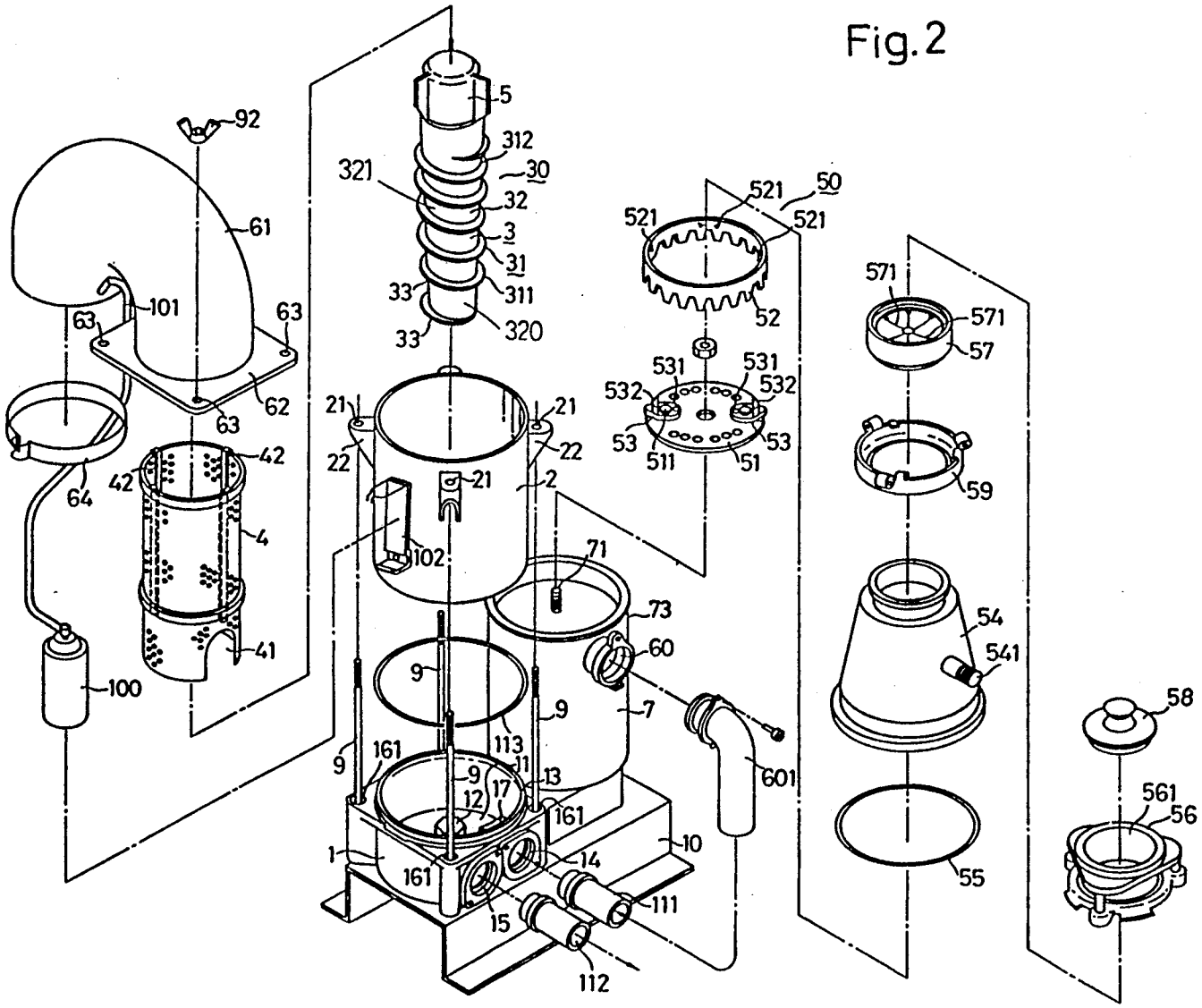
FIG. 2 is a disassembled perspective view of the same disposer.

Referring to FIGS. 1 and 2, the garbage disposer of the invention comprises a base 10, mounted thereon, a motor 7 and a garbage drying means 30 as mounted on the base, and a garbage pulverizing means 50 disposed on the motor 7.

The garbage pulverizing means 50 comprises a crushing rotor 51, a crushing ring 52, a pair of crushing members 53, 53, a cover 54, a water seal ring 55, a check valve 57, a charging port 56, a lid 58 and a connecting ring 59.

The crushing rotor 51 is directly mounted on an upper shaft 71 of the motor 7. The outside diameter of the crushing rotor 51 is slightly smaller than the outside diameter of the motor 7.

The crushing ring 52 has an inner diameter slightly larger than the outside diameter of the crushing rotor 51. The internal wall of the crushing ring 52 is provided with a plurality of cutout projections 521 extending inwardly and the lower edge of the ring 52 is serrated.

The aforesaid pair of crushing members 53, 53 is so configured that each member is generally elliptical in plan view and has a crushing projection 532 on the upper face of its forward end and an elongated groove 531 formed in the direction of its major axis at its base. The elongated grooves 531, 531 of these crushing members 53, 53 are engaged by pins 511, 511 secured toward the center of the crushing rotor 51 so that the crushing members 53, 53 may respectively slide in the radial direction of the crushing rotor 51. In this arrangement, as the motor 7 is driven to turn the crushing rotor 51, the respective crushing members are centrifugally caused to slide toward the outer circumference of the crushing rotor 51 and the locus of the crushing projections 532, 532 approach the cutout projections 521 of crushing ring 52 so that the garbage is pulverized between these crushing projections 532, 532 on the one hand and the cutout projections 521 on the other hand.

The aforesaid cover 54 covers the crushing rotor 51 and crushing ring 52 from above and is configured generally like a truncated cone. This cover 54 is rigidly secured to the upper end of a case 74 housing the motor 7 with a setscrew means through a water seal ring 55. A water supply port 541 formed in the peripheral wall of the cover 54 communicates with a water faucet so that the water necessary for crushing of garbage can be introduced into the cover 54 through this water supply port 541.

The charging port 56 is communicable with a garbage discharge port of a garbage tank at the sink and its top opening 561 is provided with said lid 58 for opening and closing.

The check valve 57 is separates the cover 54 and the charging port unit 56 from each other and is made of rubber. The check valve 57 is formed with a plurality of incisions 571 extending radially from its center. This check valve 57 is interposed between the top opening of the cover 54 and the charging port 56.

The connecting ring 59 links the cover 54 and the charging port unit 56 as a unit.

The garbage pulverizing segment 50 is not limited to the one described above but may be similar to the crushing segment of the prior art disposer.

The motor 7 is housed in a case 74 mounted on the base 10. The upper end of the case 74 is provided with an inward partitioning wall 75, forming a free space 77 between the partitioning wall 75 and the crushing rotor 51 of the garbage pulverizing segment 50. The upper shaft 71 of the motor 7 extends through this partitioning wall 75, while the lower shaft 76 is connected to a pulley 72 within the base through a speed reduction mechanism now shown.

The reference numeral 60 indicates a garbage discharge port. This garbage discharge port 60 is disposed in the peripheral wall 73 of the case 74 housing the motor 7 in such a manner that it communicates with the free space 77 so that the garbage crushed by the garbage pulverizing segment 50 is discharged from the pulverizing segment 50 via the space 77. Connected to this garbage discharge port 60 is a discharge pipe 601 which, in turn, is connected to a feed pipe 111 on the garbage charging port 14 via a hose of PVC or the like material (not shown) as will be described hereinafter.

The garbage drying segment 30 includes a bottom cylindrical member 1, a rotary shaft 12, a screw 3, a screen 4, a case 2 and a discharge pipe 61.

The cylindrical bottom member 1 has a bottom wall 11 and is provided with bolt holes 161 circumferentially 90 degrees apart. The bottom wall 11 is centrally provided with a through-hole through which the rotary shaft 12 is passed. The cylindrical bottom member 1 is further provided with a garbage charging port 14 and a water discharge port 15 in parallel on its peripheral wall. Connected to the garbage charging port 14 is a charging pipe 111 which, aforesaid, is connected to the discharge pipe 601 on the side of the garbage discharge port 60 via a hose of PVC or the like (not shown). The inner end part of the garbage charging port 14 forms a projecting orifice 17 extending into the cylindrical bottom member 1. Connected to the water discharge port 15 is the water discharge pipe 112 which is connected to a drain pipe of a sink or a sewage system, for instance, via a hose not shown.

The rotary shaft 12 is disposed in such a manner that it extends out of the base 10 into the cylindrical bottom member 1. This rotary shaft 12 is provided with a pulley 16 at its lower end and this pulley is connected to the pulley 72 on the motor 7 side via a chain or a belt 8.

The screw 3 cooperates with a screen 4 to dry the garbage crushed by the garbage pulverizing segment 50, and a lower portion corresponding to about one-third of its length constitutes a forced feed segment 320, while the remaining portion of the screw 3 constitutes a compression segment 321. This screw 3 has a helical blade 31 on the peripheral surface of its trunk portion 32. The trunk portion 32 is gradually increased in diameter from the lower end to the upper end., The helical blade 31 of the screw 3 is gradually reduced in pitch from the lower end to the upper end, and the outer diameter of the compression segment 321 is smaller than the outer diameter of the forced feed segment 320. Furthermore, this blade 31 has a plurality of anti-war pins 33 embedded in the peripheral part of its compression segment 320.

The screen 4 passes water selectively and is cylindrically configured. The inner diameter of this screen 4 is approximately equal to the outer diameter of the blade 31 at the forced feed segment 320 and the length of the screen 4 is approximately equal to the length of the screw 3. The lower end of the screen 4 is formed with a cutout 41 for accepting the projecting orifice 17 within the cylindrical bottom member 1, whereby the garbage is introduced into the screen 4 from below. The inner circumferential surface of the screen 4 which corresponds to the compression segment 321 of the screw 3 is provided with four blocking bars 42 for arresting the flow of garbage in the rotational direction of the screw 3 at equal intervals. The thickness of these blocking bars 42 is so designed that the peripheral surface of the blade 31 at the compression segment 321 of the screw 3 barely contacts the surface of the blocking bars 42.

The reference numeral 5 indicates a stirring member. This stirring member 5 is adapted to loosen the garbage compressed and dried by the screw 3 and screen 4, and as mounted on the top of the screw 3, it revolves along with the screw 3.

The case 2 is a cylindrical member disposed to enclose the screen 4. This case 2 has a diameter equal to the diameter of the bottom member 1 and is mounted on a top edge 13 of the bottom member 1 through an O-ring 113. This case 2 has, on the circumferential surface close to its upper edge, four stationary members 22 each having a bolt hole 21 at angular intervals of 90°. A deodorant can-mounting member 102 is secured to an appropriate part of the peripheral wall of the case 2.

The discharge pipe 61 constitutes a discharge way 6 for discharging the crushed and dried garbage and its forward open end portion is downwardly curved. The base of this discharge pipe 61, 1.e, the connection thereof to the case 2 in its upper position, is provided with a square flange 62. This flange 62 has bolt holes 63 at four corners. Inserted through the wall at the open end of this discharge pipe 61 is the free end of the PVC pipe 101 extending from the deodorant can 100 mounted on the mounting member 102 of the case 2. Furthermore, a bag (not shown) for collecting the dried garbage is attached to the open end portion of the discharge pipe 61 with the aid of a band 64.

The aforementioned cylindrical bottom member 1, case 2 and discharge pipe 61 are jointed in stack by means of four elongated bolts 9 erected from within the base 10 and butterfly nuts 92 respectively threaded onto the top ends of the elongated bolts 9. Thus, the elongated bolts 9 pass through the bolt holes (not shown) in base 10, bolt holes 161 in bottom member 1, bolt holes 21 in case 2, and bolt holes 63 in discharge pipe 61 in succession and the butterfly nuts 92 are respectively threaded onto the top ends of these bolts.

The reference numeral 131 indicates a chain case.

The actions of the garbage disposer of the above construction are explained below.

First, the apparatus is supplied with electric current to start the motor 7, whereupon the crushing rotor 51 of the garbage pulverizing segment 50 and the screw 3 of the garbage drying segment 30 are simultaneously driven.

The lid 58 of the garbage pulverizing segment 50 is then removed and the garbage is charged from the end opening 561 of the charging port unit 56, whereupon the garbage under its own weight pushes the check valve 57 and falls into the cover 54. By this time, the space within the cover 54 has been supplied with an appropriate amount of tap water for assisting in smooth crushing of garbage from a faucet through the water supply port 541. When a substantial amount of water entrains the garbage from the garbage tank of a sink into the cover unit 54 through the charging port 56, the above supply of water from the faucet is not required.

The water-containing garbage falling into the cover unit 54 is finely divided between the crushing projections 532, 532 of the crushing members 53, 53 and the cutout projections 521 of the crushing ring 52.

The wet garbage thus comminuted enters into the free space 77 below the crushing rotor 51, from which it travels through the garbage discharge port 60, discharge pipe 601, hose (not shown) feed pipe 111 and garbage charging port 14 into the screen 4 at the projecting orifice 17.

The wet garbage introduced into the cylindrical screen 4 is delivered upward by the revolving screw 3. First, in the forced feed segment 320 of the screw 3, the garbage is spirally fed upward within the screen 4 as the screw 3 revolves. In this course, the garbage is somewhat dried by a centrifugal force and the resulting water flows through the screen 4 into the space between the screen 4 and the case 2. The partially dried garbage is further pressure-fed upward by the screw 3 but when the garbage reaches the zone of the blocking bars 42 of the screen 4, it is arrested by blocking bars 42 against movement in the rotational direction of the screw 3 and rises along the bars 42 within the screen 4. In this connection, since the diameter of the trunk portion 32 of the screw 3 is gradually larger from the lower end to the upper end and the pitch of the blade 31 gradually diminishes from the lower end to the upper end as mentioned hereinafter, the garbage is progressively compressed as it rises so that it is efficiently dried. The resulting water flows through the screen 4 into the space between the screen 4 and the case 2. In this manner, the water passing through the screen 4 in the forced feed segment 320 and compression segment 321 of the screw 3 is discharged from the bottom of the bottom member 1 into a drain pipe at the sink or a sewage system through the water discharge port 15 and discharge pipe 112.

The garbage thus efficiently dried in the garbage drying segment 30 is loosened up by the stirring member 5 on the top of the screw 3. The loosened garbage travels through the discharge way 6 within the discharge pipe 61 and collects in a bag (not shown) attached to the open end of the discharge pipe 61 with the band 64. The dried garbage collected in the bag is discarded together with other household rubbish for disposal.

Either before or after collection of the garbage in the bag, a nozzle of the deodorant can 100 is actuated to spray the deodorant at the open end of the discharge pipe 61, whereby the malodor of the garbage is cancelled and no discomfort is felt in removing the bag from the discharge pipe 61.

While there has been described what is at present considered to be preferred embodiments of the invention, it will be understood that various modifications may be made therein, and it is intended to cover in the appended claims all such modifications as fall within the true spirit and scope of the invention.

What is claimed is:

1. A garbage disposer for comminuting wet garbage and drying the same comprising:

a base;

a garbage pulverizing means for comminuting wet garbage;

a garbage drying means for drying the garbage comminuted by said garbage pulverizing means, said garbage drying means including a) a screw having a helical blade and b) a screen disposed around said screw, said screw having a forced feed segment and a compression segment, said screw having a plurality of blocking bars on an inner circumferential surface in an area corresponding to the compression segment of the screw, thickness of said blocking bars being such that surfaces of respective bars barely contact a peripheral surface of the helical blade in the compression segment so that movement of the garbage in a rotational direction of the screw is arrested, and a plurality of anti-wear pins are embedded in an outer peripheral surface of the helical blade in the forced feed segment of the screw; and a drive means for driving both said garbage pulverizing means and said garbage drying means, said garbage pulverizing means and garbage drying means being securely and integrally mounted on said base.

2. A garbage disposer according to claim 1 wherein said drive means is a motor disposed adjacent to and in juxtaposition with said garbage drying means and said garbage pulverizing means is mounted on the top of a motor.

3. A garbage disposer according to claim 2 wherein said motor has an upper shaft and a lower shaft and is mounted on the base with an axis being oriented perpendicularly with respect to the base and said upper shaft is connected to said garbage pulverizing means, while said lower shaft is connected to said garbage drying means.

4. A garbage disposer according to claim 3 wherein said garbage drying means comprises a bottomed member having a) garbage charging port communicating with said garbage pulverizing means, said garbage charging port to accept wet crushed garbage discharged from said garbage pulverizing means and b) a water discharging port to drain water produced from drying of the garbage, a rotary shaft rotatably supported in a center of a bottom of said bottomed member, said rotary shaft to be driven by said motor, said screw having a trunk portion and said helical blade disposed around said trunk, a lower end of said trunk portion being connected to said rotary shaft, so that said screw revolves as said rotary shaft is driven, said screen to pass only water and configured in a shape of a cylinder whose inside diameter is generally equal to an outer diameter of said screw, and a case disposed externally of said screen with a free space interposed therebetween, said garbage admitted from said garbage inlet port being guided into said screen.

5. A garbage disposer according to claim 4 wherein said screw is so configured that the trunk portion of said screw is gradually increased in diameter from a lower end to an upper end.

6. A garbage disposer according to claim 5 wherein a pitch of the helical blade of said screw diminishes gradually from a lower end to an upper end.

7. A garbage disposer according to claim 4 wherein a pitch of the helical blade of said screw diminishes gradually from a lower end to an upper end.

8. A garbage disposer according to claim 4 wherein a lower portion of said screw corresponding to one-third of its length constitutes said forced feed segment to pressure-feed wet garbage upward and a remaining portion of said screw constitutes said compression segment to compress the wet garbage, a diameter of the helical blade in said compression segment being smaller than the diameter of the blade in said forced feed segment.

9. A garbage disposer according to claim 8 wherein the trunk portion of the screw is gradually increased in diameter from a lower end to an upper end.

10. A garbage disposer according to claim 8 wherein a pitch of the helical blade of said screw diminishes gradually from a lower end to an upper end.

11. A garbage disposer according to claim 10 which further comprises a stirring member for loosening dried garbage, said stirring member being disposed on a top of said screw.

12. A garbage disposer according to claim 9 wherein a pitch of the helical blade of said screw diminishes gradually from a lower end to an upper end.

13. A garbage disposer according to claim 4 which further comprises a stirring member for loosening dried garbage, said stirring member being disposed on a top of said screw.

14. A garbage disposer according to claim 11 which further comprises a stirring member for loosening dried garbage, said stirring member being disposed on a top of said screw.

15. A garbage disposer according to claim 4 wherein said garbage drying means has a discharge pipe for discharging garbage dried thereby in a predetermined direction.

16. A garbage disposer according to claim 15 wherein said discharge pipe is equipped with a band for securing a bag for collecting the garbage discharged therefrom.

17. A garbage disposer according to claim 16 which further includes a deodorant can-mounting means mounted in an appropriate position on a peripheral surface of a case for housing said garbage drying means, a can filled with a deodorant being mounted on said mounting means and a pipe being connected to said deodorant can a free end of said pipe being inserted into said discharge pipe so that the deodorant issued from said deodorant can deodorizes the dried garbage.

* * * * *